US005141344A

United States Patent [19]

Murakami et al.

[11] Patent Number: 5,141,344

[45] Date of Patent: Aug. 25, 1992

[54] SHEET FEEDING MECHANISM FOR PRINTING APPARATUS

[75] Inventors: Kenjiro Murakami; Keiichi Ohshima, both of Nagano, Japan

[73] Assignee: Seiko Epson Corporation, Tokyo, Japan

[21] Appl. No.: 743,645

[22] Filed: Aug. 12, 1991

Related U.S. Application Data

[62] Division of Ser. No. 645,513, Jan. 24, 1991.

[30] Foreign Application Priority Data

Feb. 7, 1990 [JP] Japan ..... 2-27774
Mar. 5, 1990 [JP] Japan ..... 2-54743

[51] Int. Cl.[5] ..... B41J 11/36

[52] U.S. Cl. ..... 400/579; 400/636.3; 400/625; 271/314

[58] Field of Search ..... 400/579, 600.3, 603, 400/617, 624, 625, 636, 636.3, 637, 639; 271/220, 306, 314

[56] References Cited

U.S. PATENT DOCUMENTS 3,411,686 11/1968 Bender ..... 400/636
4,500,219 2/1985 Lange et al. ..... 400/617
4,767,114 8/1988 Nishimoto ..... 400/625
4,870,258 9/1989 Mochizuki et al. ..... 400/636
4,997,179 3/1991 Mizutani et al. ..... 400/625
5,028,156 7/1991 Takano ..... 400/625

FOREIGN PATENT DOCUMENTS 81343 4/1986 Japan ..... 271/314

*Primary Examiner*—Edgar S. Burr
*Assistant Examiner*—Ren Yan
*Attorney, Agent, or Firm*—Sughrue, Mion, Zinn, Macpeak & Seas

[57] ABSTRACT

A sheet feeding mechanism for a printing apparatus capable of achieving accurate sheet feed performance free from slanted sheet feeding, dislocation between pages in printing on copy sheets, out-of-pitch printing, and the like. The sheet feeding mechanism includes a pair of confronting roller units capable not only of applying a driving-like sheet feed force to both front and back surfaces of a copy sheet, but also of maintaining a constant pressure contact force from each roller. The shafts of the pair of confronting roller units are driven so that the sheet feed force is stable. The pressure contact force is produced by a structure wherein each roller is biased by independent loading.

7 Claims, 7 Drawing Sheets

SHEET FEEDING MECHANISM FOR PRINTING APPARATUS

This is a divisional of application Ser. No. 07/645,513 filed Jan. 24, 1991.

BACKGROUND OF THE INVENTION

The present invention relates to a sheet feeding mechanism for a printing apparatus which feeds or discharges print sheets with two confronting roller units, each of which is composed of rollers and a shaft.

A sheet feeding mechanism for a printing apparatus which feeds or discharges print sheets with two confronting roller units generally has a structure wherein the group of rollers constituting one of the two confronting roller units is not biased by an independent loading device. Specifically, as shown in FIG. 1 (which is taken from Japanese Patent Unexamined Publication No. 197339/1986), bias rollers 31 forming a second roller unit 30 arranged so as to confront drive rollers 29 forming a first roller unit 28 are biased by no independent loading device. Even in cases where the group of rollers constituting one of these two confronting roller units is biased by an independent loading device, the rollers have not been driven thereby. That is, as shown in FIG. 2 (taken from Japanese Patent Unexamined Publication No. 285841/1987), each of bias rollers 35 forming a second roller unit 34 arranged so as to confront drive rollers 33 forming a first roller unit 32 is biased by an independent loading device, but they are not driven thereby.

The above-described sheet feeding mechanisms entail the problem of not providing a feeding force to one of the surfaces of the print sheet if the rollers in one of the pair of rollers are idle. Even if both rollers of the pair of rollers are driven, since neither roller is biased by an independent loading device, the pressure contact force applied to the print sheet is not uniform. When a copy sheet is used as a print sheet, because the two surfaces of the sheet have dissimilar properties, dislocation tends to occur between the front and back surfaces of the sheet when the sheet is fed or discharged, or the sheet feeding force is not stably applied at the roller unit section, thus causing such problems as slanted sheet feeding and out-of-pitch printing.

The invention further relates to a print sheet feed mechanism suitable for use in serial printers.

Because serial printers usually print characters, patterns, and the like on a print sheet while the print sheet is wrapped around the surface of a platen, they are provided with a sheet bias plate on the bottom side of a print head moving path and a paper bale on the upper side thereof. The upper and lower regions interposing the print head moving path are held by these members to prevent dislocation of the sheet.

With this arrangement, nothing can be printed on the head and tail end regions of a sheet in areas defined by the distance between the print head and the paper bale and the distance between the print head and the sheet bias plate, thereby entailing inconveniences when printing slips, labels, and the like.

SUMMARY OF THE INVENTION

The invention has been made to overcome the above problems, and therefore has an object the provision of a sheet feeding mechanism for a printing apparatus capable of achieving accurate sheet feed performance free from slanted sheet feeding, dislocation between pages in printing on copy sheets, out-of-pitch printing, and the like.

In accordance with the above and other objects, the invention provides a sheet feeding mechanism for a printing apparatus having a pair of confronting roller units capable not only of applying a driving-like sheet feed force to both front and back surfaces of a copy sheet, but also of maintaining a constant pressure contact force from each roller. Further, the shafts of the pair of confronting roller units are driven so that the sheet feed force is stable. In addition, the pressure contact force is produced by a structure wherein each roller is biased by independent loading.

According to the above structure of the invention, a drive force is applied to both the front and back surfaces of the print sheet with the pressure contact force being applied uniformly from each roller to the print sheet. Thus, the sheet feed force acting on the print sheet becomes stable, allowing a correct, highly reliable sheet feed operation to be performed without sheet dislocation, out-of-pitch printing, or inclined printing in the copy sheet.

Another object of the invention is the provision of a print sheet feed mechanism for serial printers capable of printing without producing any dead space in the sheet feed direction.

Overcoming the above problems, the invention provides a print sheet feed mechanism for serial printers which comprises a platen for receiving the bias force from a print head, first and second guide plates arranged at both sides of the platen in such a manner as to be substantially coplanar with a print region of the platen, first and second sheet feed rollers arranged outside the first and second guide plates, and a sheet guide member which moves together with the print sheet and at least whose portion confronting the platen is elastically biased on the platen at all times.

When a sheet is fed to the print region, it is guided to the platen by the guide plates and the sheet guide, while when the head end of the sheet arrives at the platen, the sheet is biased on the platen with at least one side of the sheet clamped by the first or second sheet feed roller to prevent dislocation of the sheet at the time of printing.

This dispenses with clamping the sheet at both sides of the platen, thereby allowing printing to be performed while reducing the dead space on the head and tail ends of the sheet as much as possible.

DESCRIPTION OF THE PREFERRED EMBODIMENTS

Preferred embodiments of the invention will be described with reference to the accompanying drawings.

Figure 1:
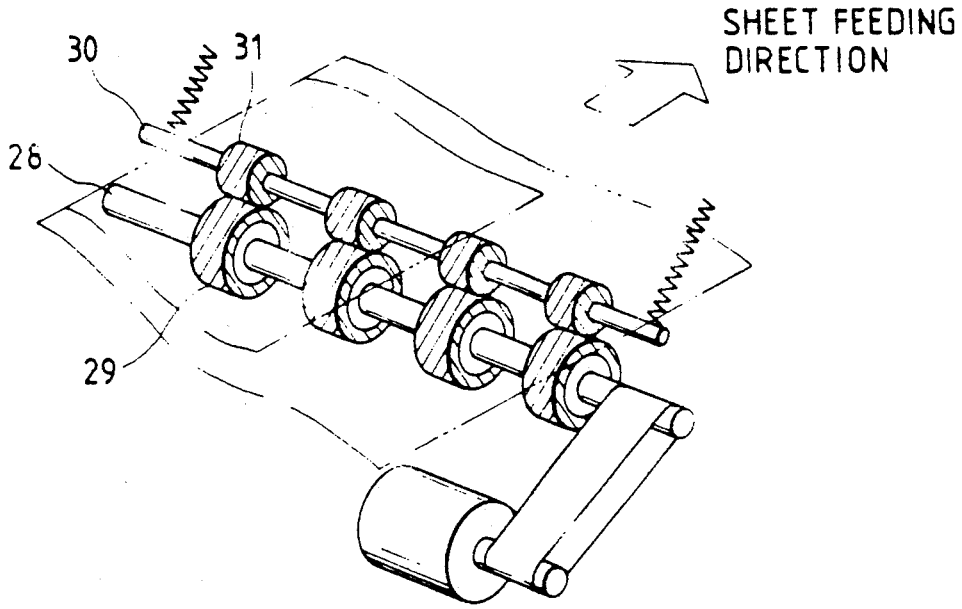
FIG. 1 PRIOR ART
FIGS. 1 and 2 are diagrams showing a conventional sheet feeding mechanism.
Figure 2:
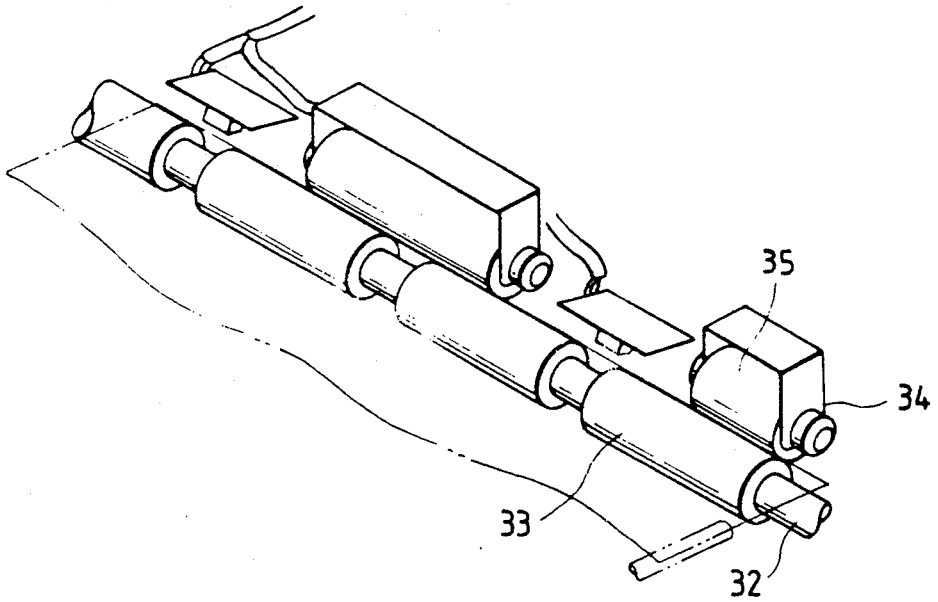
FIG. 2 PRIOR ART
Figure 3:
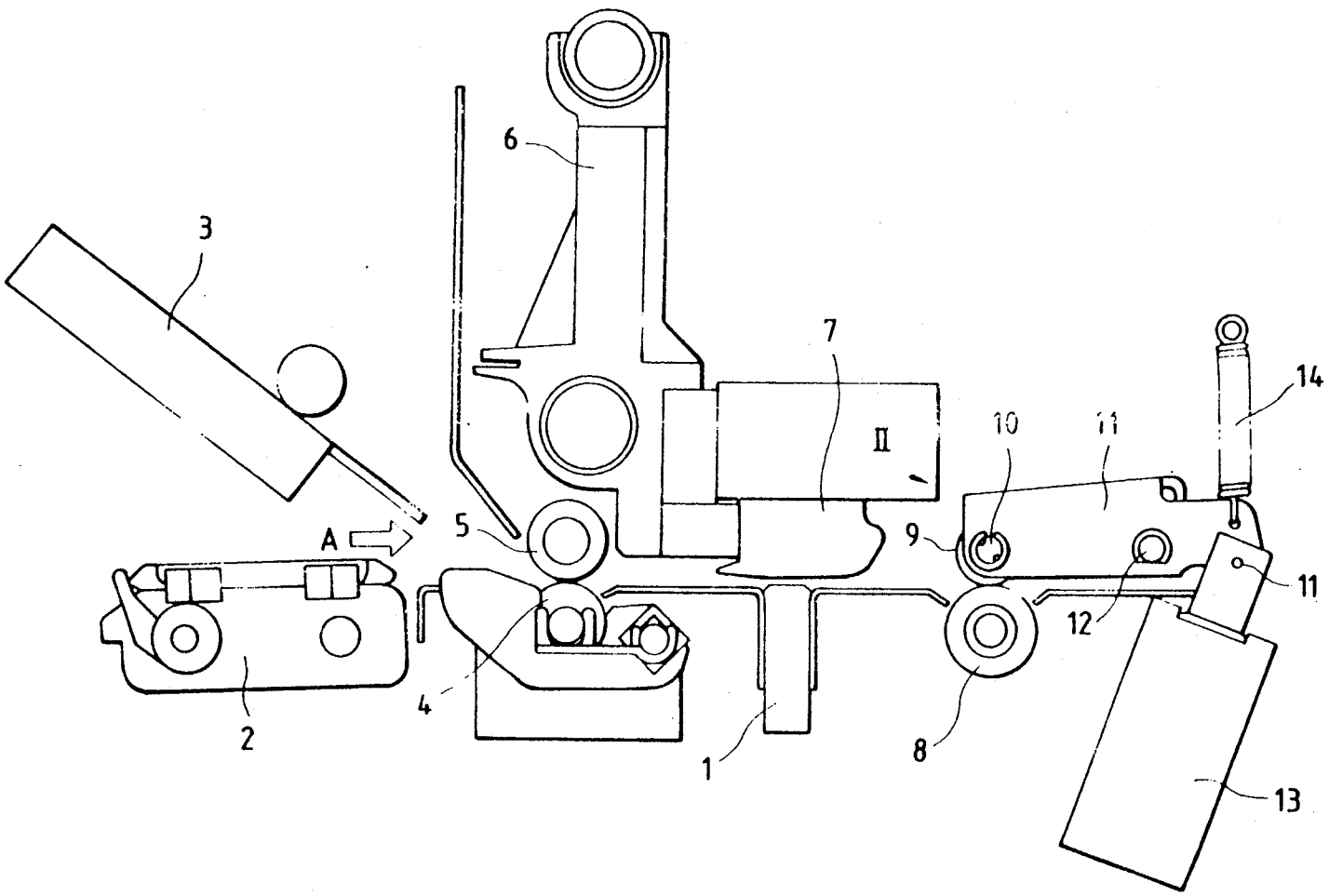
FIG. 3 is a sectional view showing the main body of a printing apparatus constructed in accordance with a preferred embodiment of the invention.

FIG. 3 is a sectional view generally showing a printing apparatus to which an embodiment of a sheet feeding mechanism of the invention is applied. In FIG. 3, reference numeral 1 indicates a platen having a push tractor 2 for feeding a continuous sheet and a cut sheet feeder 3 for feeding a cut sheet, both arranged upstream in a sheet feed direction (indicated by an arrow A in FIG. 3). The sheet fed by these components passes between a sheet feed roller 4 and a sheet bias roller 5 and is printed at the upper position of the platen 1 by a print head 7 mounted on a carriage 6.

Downstream of the platen 1 are sheet discharge feed rollers 8 forming a first roller unit and sheet discharge bias rollers 9 forming a second roller unit. Each sheet discharge bias roller 9 is rotated integrally with a sheet bias roller shaft 10, which is a second drive shaft. The sheet discharge bias roller shaft 10 is supported by a sheet discharge unit frame 11 at both ends thereof. The sheet discharge unit frame 11 is arranged so as to be oscillatable clockwise by the attracting force of a solenoid 13 engaged with an end 11-a of the sheet discharge unit frame 11 with a sheet discharge unit pivot shaft 12 as a pivot. The sheet discharge unit frame 11 is also biased counterclockwise by coil springs 14, 25 (see FIG. 4).

Figure 4:
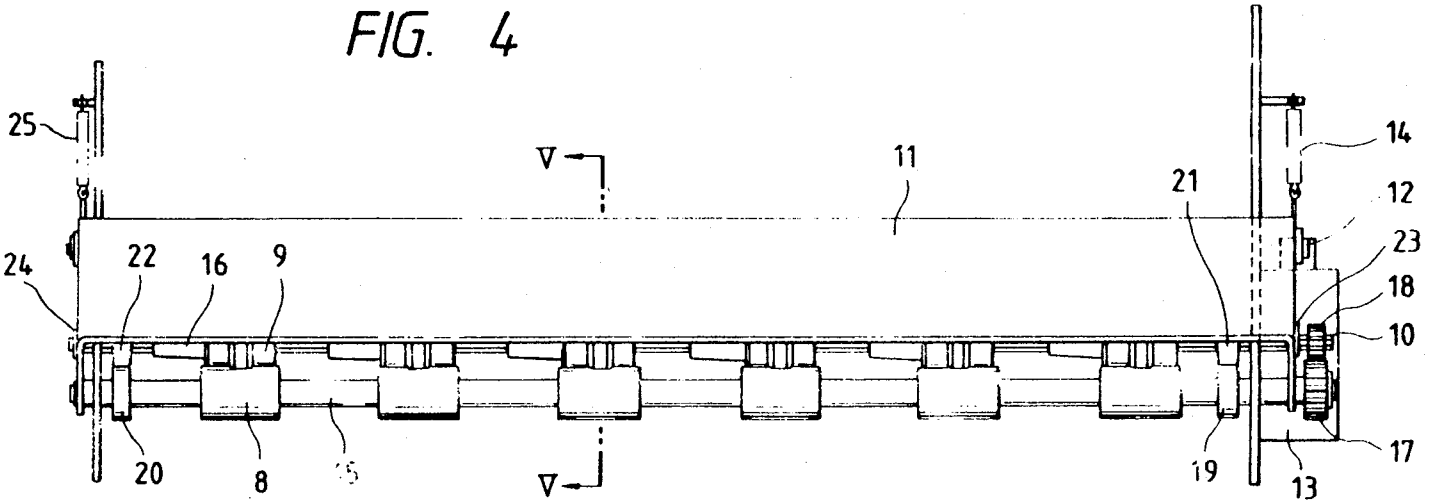
FIG. 4 is a perspective view showing the construction of a sheet discharge roller section viewed from the position of an arrow IV shown in FIG. 3.

FIG. 4 is a diagram of a sheet discharge roller section viewed substantially from a position indicated by an arrow II shown in FIG. 3. The sheet discharge feed roller 8 is disposed at a position confronting the sheet discharge bias roller 9, and six pairs of similar rollers are arranged along the length of a sheet discharge feed roller shaft 15. Each sheet discharge bias roller 9 rotates in synchronism with the sheet discharge bias roller shaft 10 while being self-aligned by a joint bush 16, as will be described later.

The sheet discharge bias roller shaft 10 is driven by a rotating force provided by a transmission gear 17 fixed on the sheet discharge feed roller shaft 15 through a transmission gear 18 fixed on itself. The sheet discharge bias roller shaft 10 also has bias rollers 21, 22 assembled at positions confronting receiving rollers 19, 20 assembled on the sheet discharge feed roller shaft 10 with the distance between the sheet discharge feed roller shaft 15 and the sheet discharge bias roller shaft 10 maintained constant. At both ends of the sheet discharge unit frame 11 are disposed the coil springs 14, 25 mounted so as to support the sheet discharge bias roller shaft 10 through bearings 23, 24.

Figure 5:
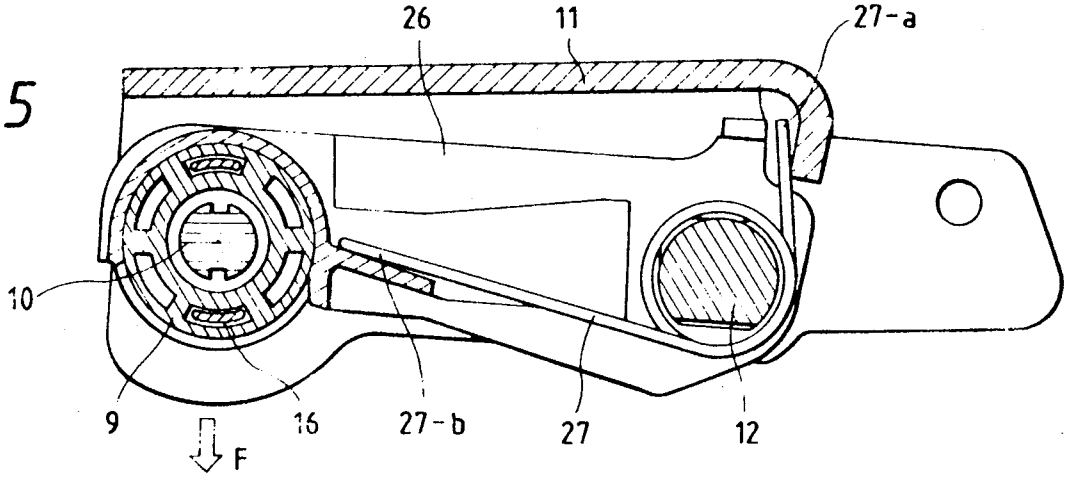
FIG. 5 is an enlarged view of FIG. 4 taken along a line V—V in FIG. 4.

FIG. 5 is an enlarged view of the sectional view taken along a line V—V shown in FIG. 4. A bias force F applied from the sheet discharge bias roller 9 to the sheet discharge feed roller 8 is provided by a sheet discharge unit lever 26 (see FIG. 6) mounted so as to be rotatable around the sheet discharge unit pivot shaft 12. The sheet discharge unit pivot shaft 12 has a sheet discharge lever spring 27 assembled, with arms 27-a, 27-b of the sheet discharge lever spring 27 being in contact with the discharge unit frame 11 and the discharge unit lever 26, respectively.

Figure 6:
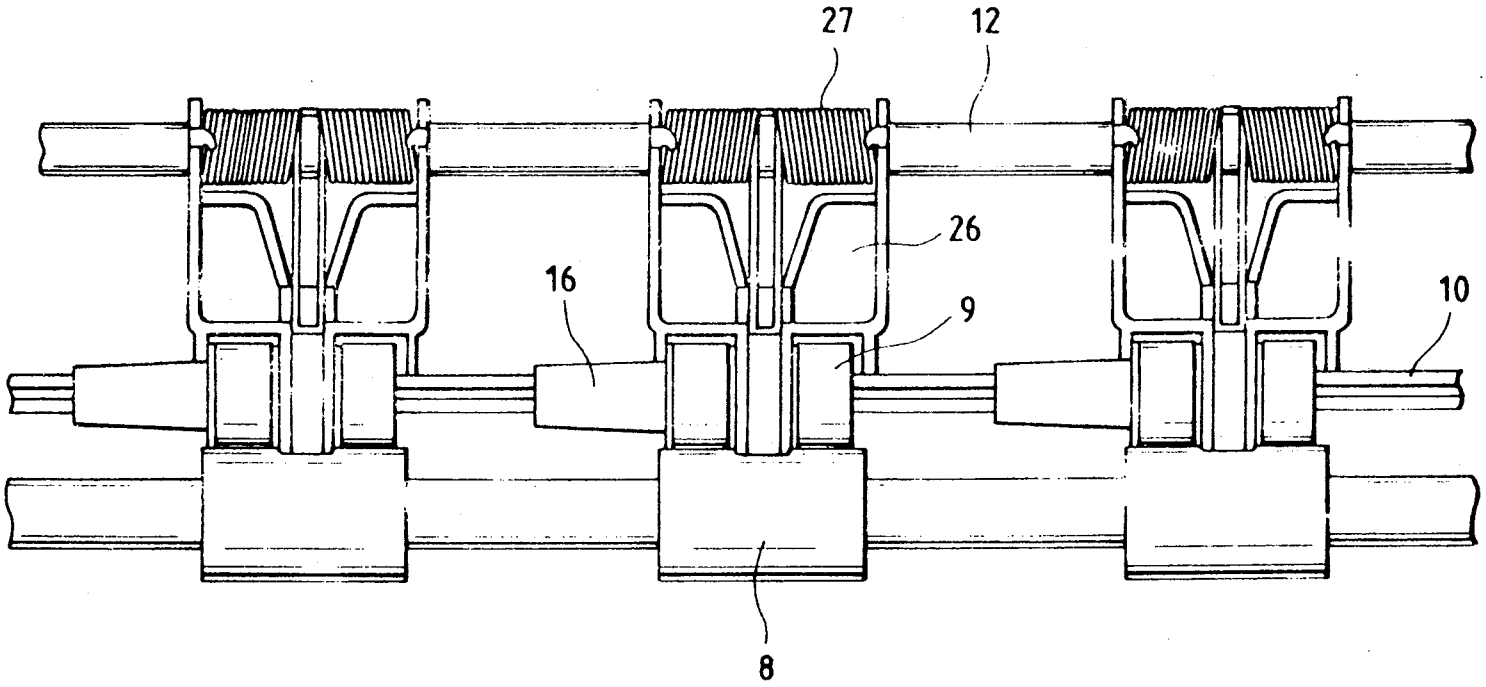
FIG. 6 is a partially enlarged view of FIG. 4 without a sheet discharge unit frame.

FIG. 6 is a partially enlarged view of FIG. 4 without the sheet unit frame 11. A load applied from the sheet discharge lever spring 27 is transmitted to the sheet discharge bias roller 9 through the sheet discharge unit lever 26 so that the bias force is applied to the sheet discharge feed roller 8.

Figure 7:
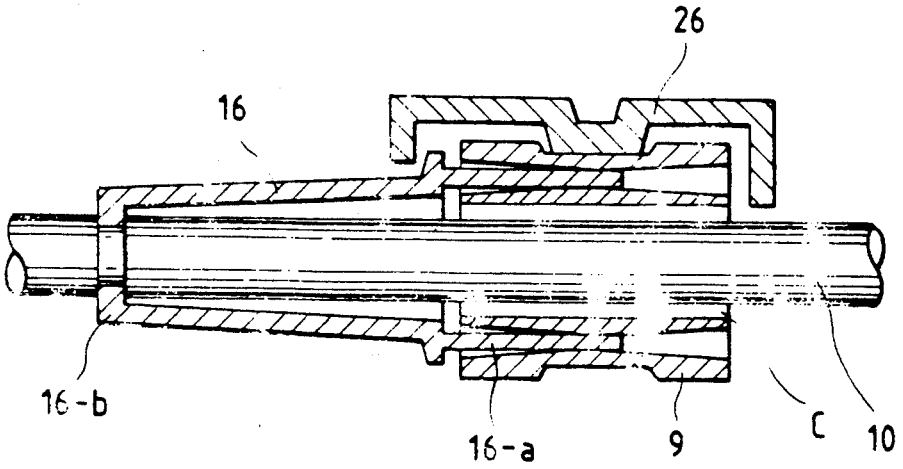
FIG. 7 is an enlarged sectional view showing a sheet discharge bias roller section.

FIG. 7 is a detailed sectional view of the sheet discharge bias roller section shown in FIG. 6. The sheet discharge bias roller 9 has a front end portion 16-a of the joint bush 16 inserted thereinto so that the front end portion 16-a can rotate integrally with the sheet discharge bias roller 9. The joint bush 16 has a self-aligning structure so as to absorb the oscillation (mainly vertical oscillation) of the sheet discharge bias roller 9. The joint bush 16 rotates integrally with the sheet discharge bias roller shaft 10.

Figure 8:
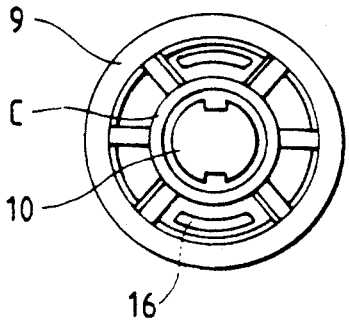
FIG. 8 is a transverse sectional view showing the sheet bias roller section.

FIG. 8 is a detailed view showing the relationship between the sheet discharge bias roller 9 and the joint bush 16. The sheet discharge bias roller shaft 10 is a shaft whose diameter is different from the sheet discharge bias roller 9 so as to obtain a predetermined clearance C between the sheet discharge bias roller 9 and itself.

The operation of the above embodiment will now be described in detail.

In FIG. 3, a print sheet fed by the cut sheet feeder 3 or the push tractor 2 is printed by the print head 7 and then discharged past the sheet discharge unit section. Since each sheet discharge bias roller 9 in the sheet discharge unit section has a load applied independently from its corresponding sheet discharge lever spring 27, a uniform load is applied to the print sheet from each roller.

Even in the case where the sheet discharge bias roller 9 is dislocated vertically due to irregularities on the surface of the print sheet, changes in the thickness of the print sheet, or passage of perforations of the print sheet, the resulting oscillation of the sheet discharge bias rollers 9 is not transmitted to the sheet discharge bias roller shaft 10 owing to the presence of the clearance C between the sheet discharge bias roller 9 and the sheet discharge bias roller shaft 10, as is apparent from FIG. 7. Therefore, the engagement between the transmission gears 17, 18 in FIG. 4 is stable, and the rotating force of the sheet discharge bias roller shaft 10 is stably transmitted to each sheet discharge bias roller 9 through its corresponding joint bush 16, thereby allowing each sheet discharge feed roller 8 and each sheet discharge bias roller 9 to be provided with the drive force stably.

According to the invention, a sheet feed force is applied to both the front and back surfaces of the copy sheet so as to drive the print sheet. The stable and uniform application of the bias force from each roller to the print sheet advantageously allows copy sheets to be fed correctly and reliably, preventing sheet dislocation, out-of-pitch printing, and inclined printing.

Figure 10:
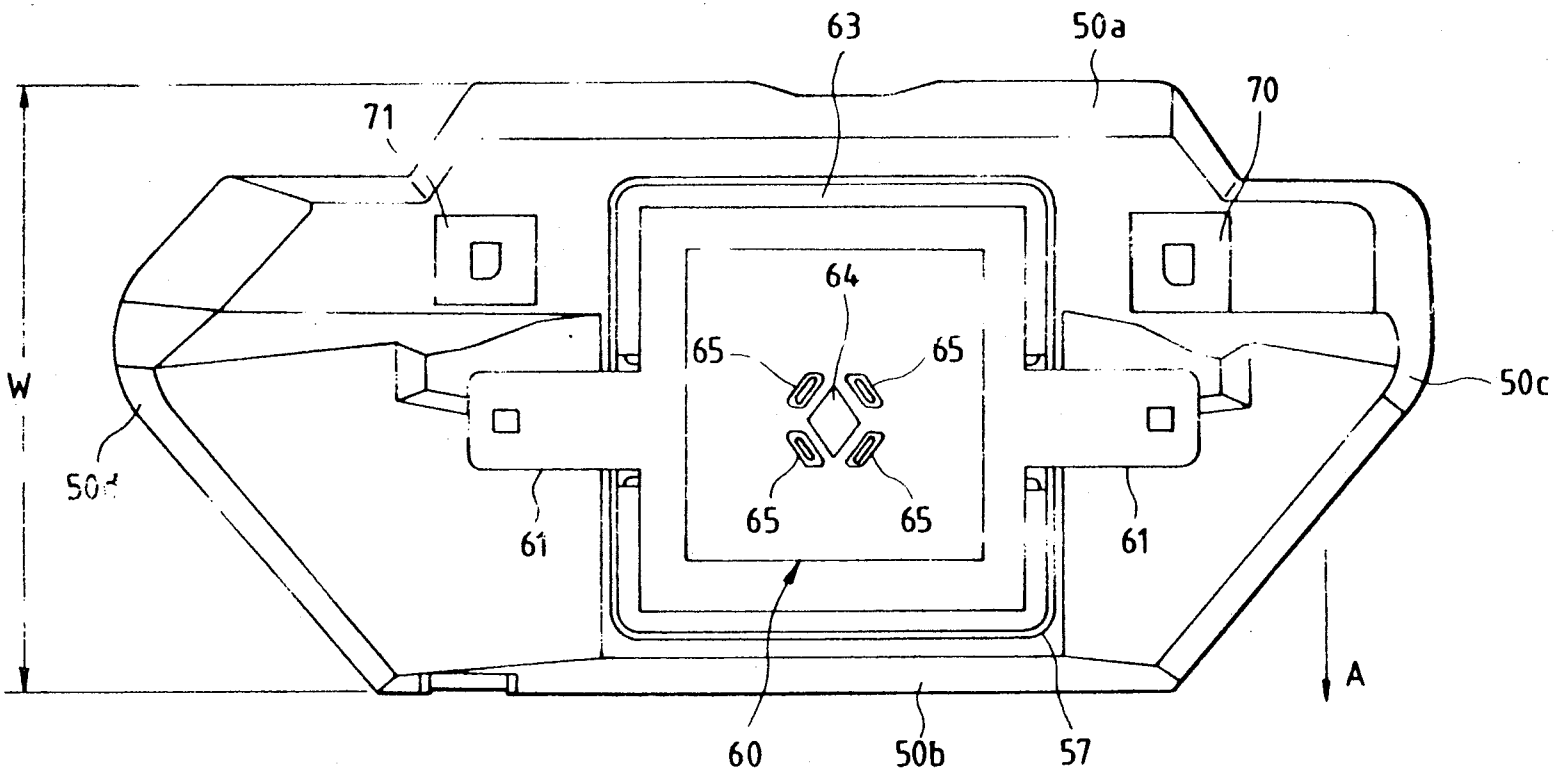
FIGS. 10 and 11 are a front view and a sectional view of a sheet guide member to be used in the mechanism shown in FIG. 9 as viewed from a print head side.
Figure 11:
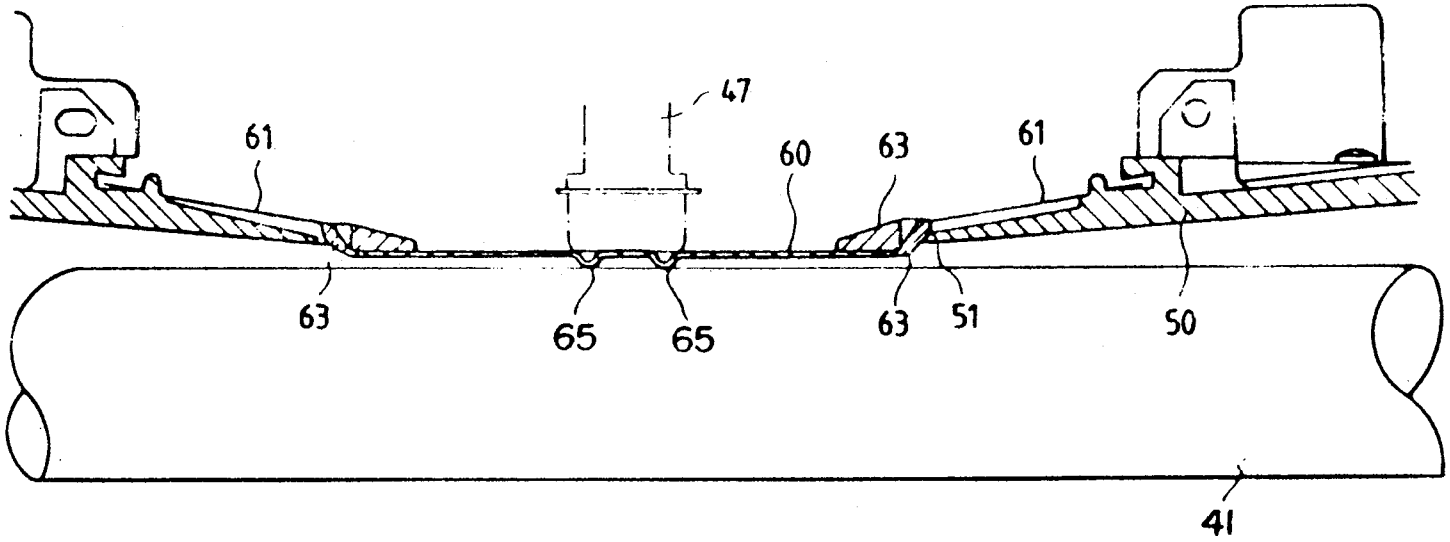

Another embodiment of the invention will be described in detail with reference to an embodiment illustrated in FIGS. 9 through 11 of the accompanying drawings.

Figure 9:
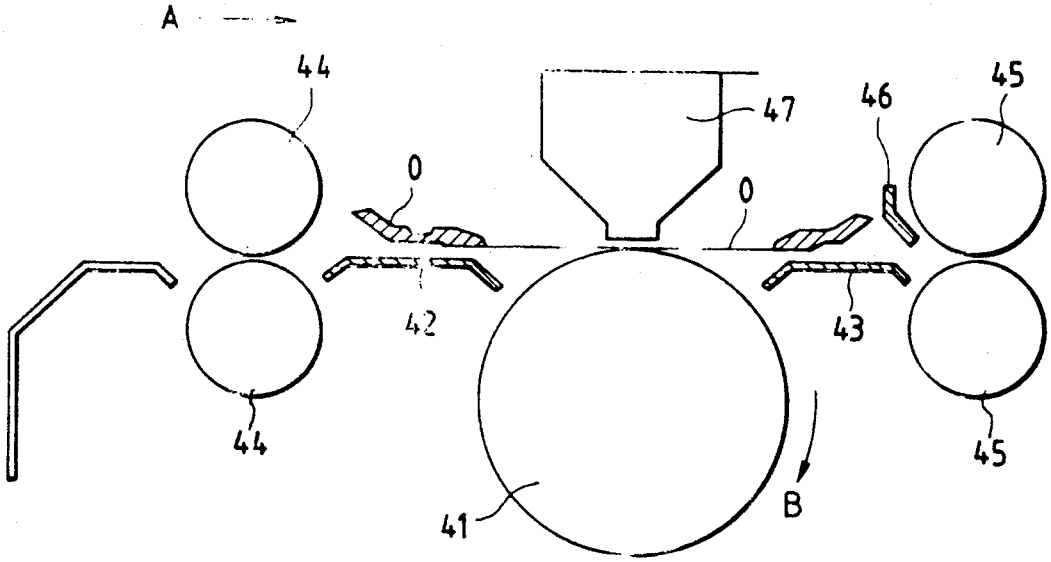
FIG. 9 is a sectional view showing a print sheet feed mechanism of another embodiment of the invention.

In FIG. 9, reference numeral 41 designates a platen. In a print sheet feed direction (designated by A in FIG. 9), first and second guide plates 42, 43 are arranged so as to interpose the platen 41 therebetween. The guide plates 42, 43 are disposed at positions slightly lower than a plane including the print region on the platen 41, that is, at a level lower toward the platen 41, so that a gap which is wide enough to allow the print sheet to move therethrough is formed between the guide plates 42, 43 and a print sheet guide member (described below).

Outside each of the guide plates 42, 43 are first sheet feed rollers 44 and second sheet feed rollers 45 arranged so that the points of contact of the sheet feed rollers 44, 45 are substantially coplanar with the surfaces of the guide plates 42, 43.

Reference numeral 46 designates a head end guide plate arranged between the second sheet feed rollers 45 and the second guide plate 43, the location of which is viewed in the drawing as being downstream at the time of printing. The head end guide plate 46 on entry side the printing sheet is expanded.

Reference numeral 47 designates a print head mounted so as to be capable of reciprocating in an axial direction (the direction perpendicular to the drawing sheet in FIG. 9) of the platen 41 by a guide rod (not shown).

Reference numeral 50 designates a sheet guide member. Its width W in the sheet feeding direction is selected so that both ends thereof overlap with the first and second guide plates 42, 43. The sheet guide member 50 is mounted on a carriage so that a predetermined gap is maintained with respect to the guide plates 42, 43. The edge portions 50*a*, 50*b* on both entry and exit sides of the print sheet are expanded so as to facilitate the entry of the sheet. The edge portions 50*c*, 50*d* in the carriage moving direction are also expanded against the platen 41 so that the sheet will not be drawn in when the carriage moves. A window 51 is formed in the middle, and a sheet bias plate 60 is mounted so as to project toward the platen 41 while being elastically biased by plate springs 61.

Along a line parallel to the carriage moving direction there are provided two sheet detecting elements 70, 71 arranged so as to interpose dot-forming elements therebetween. The sheet bias plate 60 has a flat surface which abuts against the platen 41 and has the belt-like extending spring members 61 formed on both sides thereof in the carriage moving direction. The peripheral portion around the sheet bias plate 60 is reinforced by a synthetic resin frame 63 which is chamfered in both the sheet feeding direction and the carriage moving direction. At a portion confronting the dot-forming elements of the print head 47 is a dot forming element exposing window 64, while around the dot-forming element exposing window 64 are a plurality of spherical projections 65 which project toward the platen 41.

In this embodiment, when the print sheet is fed by driving the first sheet feed rollers 44, the print sheet is moved toward the platen 41 with one of its surfaces guided by the surface of the first guide plate 42 and the other surface by the sheet guide member 50 until it is pressed onto the platen 41 by elasticity or by the firmness of the sheet. Further, when the sheet has been pressed onto the platen 41, the head end of the sheet causes the sheet bias plate 60 to be retracted toward the print head 47 while resisting the elasticity of the spring members 61. As a result, the sheet is elastically biased on the platen 41 by the sheet bias plate 60 when the sheet enters the gap between the platen 41 and the sheet bias plate 60. When the platen 41 is rotated in the sheet feed direction (indicated by the arrow B in FIG. 9) under this state, the head end of the print sheet moves toward the dot-forming element exposing window 64 of the sheet bias plate 60. When the head end is moving, the print sheet is floated up from the dot forming element exposing window 64 by the spherical projections 65, thereby preventing the head end of the print sheet from being caught by the window 64.

When the printing is started upon the head end of the print sheet confronting the window 64, the head end of the print sheet is fixed by being elastically biased on the surface of the platen 41 by the sheet bias plate 60, and characters and patterns are printed by the dot forming elements under this state.

The sheet guide member 50 and the sheet bias plate 60 should of course move as the print head 47 moves. Thus, the sheet has its head end interposed between the sheet bias plate 60 and the platen 41 while clamped by the first sheet feed rollers 44, thereby preventing the print region from moving unexpectedly.

When the head end of the sheet has passed through the second guide plate 43 and arrives at a position immediately before the head end guide plate 46 as printing proceeds, the print head 47, upon reaching the end of a printing line, moves farther to the lateral edge of the sheet without returning to a next line start position. Accordingly, the head end portion of the sheet is squeezed along the second guide plate 43 so as to be biased thereon by the end portion 50*b* of the sheet guide member 50. As a result, the sheet can enter the head end guide 46 smoothly even when the head end of the print sheet is floated.

It should be noted that the sheet cannot be dislocated unexpectedly under the state of being interposed between the first and second sheet feed rollers 44, 45 because it is biased not only by the sheet bias plate 60 but also by the sheet feed rollers 44, 45.

As the printing proceeds further and the tail end of the sheet exits from the first sheet feed rollers 44, the sheet has, in a manner similar to that of the head end, not only its print region elastically biased on the platen 41 by the elasticity of the sheet bias plate 60, but also its head end side interposed between the second sheet feed rollers 45, thereby preventing dislocation of the sheet.

While the case where the print sheet is inserted from the first sheet feed rollers 44 has been discussed, the sheet may be set to its print region by rotating the sheet feed rollers 44, 45 and the platen 41 reversely and moving the sheet from the side of the second sheet feed rollers 45.

Further, while a wire-dot print head has been considered as an example in this embodiment, it is obvious that the same advantages can be achieved by an ink jet type print head or thermal transfer type print head.

Moreover, while the case where the print sheet is fed horizontally has been discussed, it is obvious that the same advantages can be provided by feeding the sheet vertically.

As described above, a print sheet feed mechanism of the invention includes a platen for receiving a bias force from the print head, first and second guide plates arranged at both sides of the platen so as to be substantially coplanar with the print region on the platen, first and second sheet feed rollers disposed outside the first and second guide plates, and a sheet guide member which moves together with the print head and at least whose portion confronting the platen is elastically biased on the platen at all times.

Therefore, dislocation of the sheet in the axial direction of the platen can be prevented by either the first or the second sheet feed roller, while the dislocation of the print region can be prevented by the elastic force from the sheet guide member. As a result, the print sheet can be printed without leaving any dead space at its head and tail end regions. If a print head using an inked ribbon is employed, the second sheet guide plate provides a gap between the inked ribbon and the print sheet, thereby dispensing with a ribbon mask.

What is claimed is:

1. A sheet feeding mechanism for a printing apparatus, comprising: a first drive shaft; a first roller unit including a plurality of rollers which rotate integrally with said first drive shaft; a second drive shaft; a second roller unit having rollers mounted on said second drive shaft and constrained to rotate integrally with said second drive shaft while in pressure contact with said plurality of rollers in said first roller unit, said second roller unit confronting said first roller unit; and a plurality of independent loading means, each of said rollers in said second roller unit receiving a load applied by a respective one of said independent loading means so that each of said confronting rollers receives a pressure contact force therefrom.

2. The sheet feeding mechanism of claim 1, wherein each of said rollers of said second roller unit have an inner diameter greater than an outer diameter of said second drive shaft so as to form a gap between the rollers of said second roller unit and said second drive shaft.

3. The sheet feeding mechanism of claim 2, wherein each said independent loading means comprises a joint bush having one end fixed to said second drive shaft and a second end attached to a respective one of said rollers of said second roller unit so that said respective roller is movable in a direction perpendicular to said second shaft through the distance of said gap.

4. The sheet feeding mechanism of claim 3, wherein each of said independent loading means further comprises arm means contacting one of said rollers, and spring means for biasing said arm means into contact with said one of said rollers.

5. The sheet feeding mechanism of claim 4, including a groove in each of said rollers of said second roller unit and said arm means has a projecting portion received in said groove in said roller, in said roller.

6. The sheet feeding mechanism of claim 4, further comprising a unit frame, having end portions and first and second side ends of said second shaft being rotatably supported by said end portions of said unit frame at said first side of said frame, and a pivot shaft upon which said unit frame is pivotally mounted, said pivot shaft being parallel to said second drive shaft, said spring means having a portion wound around said pivot shaft.

7. The sheet feeding mechanism of claim 6, further comprising a solenoid coupled to said second side of said unit frame opposite said first side for pivoting said unit frame around said pivot shaft, and second spring means attached to said unit frame for biasing said unit frame such that said rollers of said second unit are pressed against respective rollers of said first unit.

* * * * *